United States Patent [19]

McKibben

[11] Patent Number: 4,967,909

[45] Date of Patent: Nov. 6, 1990

[54] PACKAGE WITH SLIDING CLOSURE/SHEET PRODUCT ELEVATOR

[75] Inventor: Gary E. McKibben, Middletown, Ohio

[73] Assignee: The Procter & Gamble Company, Cincinnati, Ohio

[21] Appl. No.: 459,170

[22] Filed: Dec. 29, 1989

[51] Int. Cl.[5] ..... B65D 1/34

[52] U.S. Cl. ..... 206/556; 206/555; 221/247; 221/249; 229/10; 229/11

[58] Field of Search ..... 206/39, 39.3, 39.4, 206/555, 556, 817, 270; 221/247, 248, 249; 229/11, 10

[56] References Cited

U.S. PATENT DOCUMENTS

| | | | |
|---|---|---|---|
| 1,185,560 | 5/1916 | Walcutt | 229/20 |
| 1,451,069 | 4/1923 | Hanson | 206/39.4 |
| 1,953,418 | 4/1934 | Macdonald | 229/11 |
| 2,480,729 | 8/1949 | Guest | 221/249 |
| 3,279,593 | 10/1966 | Cote | 206/817 |
| 3,974,956 | 8/1976 | Delang | 229/20 |
| 3,977,520 | 8/1976 | Grimm | 206/270 |
| 4,049,117 | 9/1977 | Grimm | 206/270 |
| 4,240,548 | 12/1980 | Stio | 229/11 |
| 4,267,926 | 5/1981 | Toimil | 229/20 |
| 4,646,937 | 3/1987 | Doshi | 206/817 |

*Primary Examiner*—David T. Fidei

*Attorney, Agent, or Firm*—R. C. Witte; J. V. Gorman; M. E. Hilton

[57] ABSTRACT

A cartonboard container for housing and facilitating removal of sheet products one at a time. The container includes a receptacle for housing a stack of individual sheet products. The receptacle has a top wall, bottom wall and a side wall encompassing and connecting the top wall to the bottom wall forming an enclosure. A sliding closure member is disposed about the receptacle which is selectively reciprocally slideable axially along the receptacle between a closed position covering the dispensing aperture and an open position. A pair of interior hinged panels attached to the sliding closure member extend inwardly into the container to elevate one end of the stack of sheet products when the sliding closure member is moved toward the open position. This allows for easy grasping of the transverse edge of one sheet product for removal through the dispensing aperture. Additionally, there is a set of two exterior hinge panels which connect the sliding closure member to the receptacle and extend outwardly from the container when the sliding closure member is moved to the open position. Thus, the package will close when it is laid upon a reseting surface which forces these panels flat against the receptacle. The dispensing aperture can be formed by manually removing an area in the top wall delimited by a tear line.

20 Claims, 9 Drawing Sheets

PACKAGE WITH SLIDING CLOSURE/SHEET PRODUCT ELEVATOR

BACKGROUND OF THE INVENTION

1. FIELD OF THE INVENTION

The present invention relates to cartonboard containers, and more particularly, to such containers having sliding closure members.

2. DESCRIPTION OF THE PRIOR ART

An abundance of consumer products, from milk to detergent to matches to diapers, are delivered to consumers in cartonboard containers. These containers are often used because they are o environmentally friendly, versatile and relatively inexpensive to make and transport. Consumers are often keenly aware of the sanitary and aesthetic aspects of such containers yet many of today's cartonboard containers lack these characteristics. To gain consumer acceptance, therefore, it is desirable that cartonboard containers have an easy opening and reclosing feature to promote aesthetics and sanitation.

Another drawback which often accompanies today's cartonboard containers is the inability to effectively dispense the product from the container. In many instances the consumer is required to reach into the container and grasp a single product unit for removal and use. It is often difficult, however, to grasp and remove only one product unit. This process is especially troubling with non-rigid sheet products. Nonrigid sheet products are relatively supple or pliable products having a small height dimension in relation to the width and depth dimensions. These products include feminine napkins, diapers, facial tissue, and paper which are often used one sheet at a time. Grasping an edge of only one sheet for removal from the carton is frequently a troubling task. Often, since the sheets lay against one another several sheets are grasped and removed. The extra sheets must then be stored outside the carton or simply wasted. Consequently, there is a need for a container which facilitates the grasping and removal of sheet products from cartonboard containers for removal one at a time.

Although there have been many containers which include an easy opening and reclosing mechanism, none have combined this feature with a means for aiding removal of sheet products. For example, two U.S. Pat. Nos. issued to Grimm (4,049,117 and 3,977,520 issued Sept. 20, 1977 and Aug. 31, 1976, respectively) disclose a cartonboard container having a slide actuated closure member. Axial reciprocating movement of the slide causes the end mounted closure member to rotate between open and closed positions. Once the closure member is in the open position the user grasps the exposed end portion of the product and removes it. This container, however, has no mechanism to facilitate grasping and removal of only one of the product units thereon.

Accordingly, it is an object of the present invention to provide an easy opening and reclosing cartonboard container for sheet products which includes a mechanism for facilitating removal of product units one at a time therefrom;

It is additionally an object of the present invention to provide such a container having pleasing aesthetic and sanitary characteristics;

It is further an object of the present invention that the container is biased toward the closed position when placed on a resting surface;

It is also an object of the present invention to provide such a container which promotes grasping an edge of one of the sheet products;

It is lastly an object of the present invention to provide a cartonboard container which accomplishes the aforementioned objectives at minimal costs.

SUMMARY OF THE INVENTION

In accordance with one aspect of the present invention a cartonboard container is provided for housing and facilitating removal of sheet products one at a time. The container comprises a receptacle for housing a stack of individual sheet products. The receptacle includes a top wall, a bottom wall, and a side wall which encompasses and connects the top wall to the bottom wall to form an enclosure. The top wall has a dispensing aperture for removal of the sheet product units individually therethrough. The container further comprises a sliding closure member disposed about the receptacle and which is selectively reciprocally slideable axially along the receptacle between a closed position covering the dispensing aperture and an open position. The container further comprises means hingedly attached to the sliding closure member and the receptacle for elevating one end of the stack of sheet products within the receptacle toward the dispensing aperture whereby manual grasping of one of the sheet products is facilitated.

BRIEF DESCRIPTION OF THE DRAWINGS

While the specification concludes with claims which particularly point out and distinctly claim the invention, it is believed the present invention will be better understood from the following description of a preferred embodiment taken in conjunction with the accompanying drawings, in which like reference numerals identify identical elements and wherein;

DESCRIPTION OF THE PREFERRED EMBODIMENT

Figure 1:
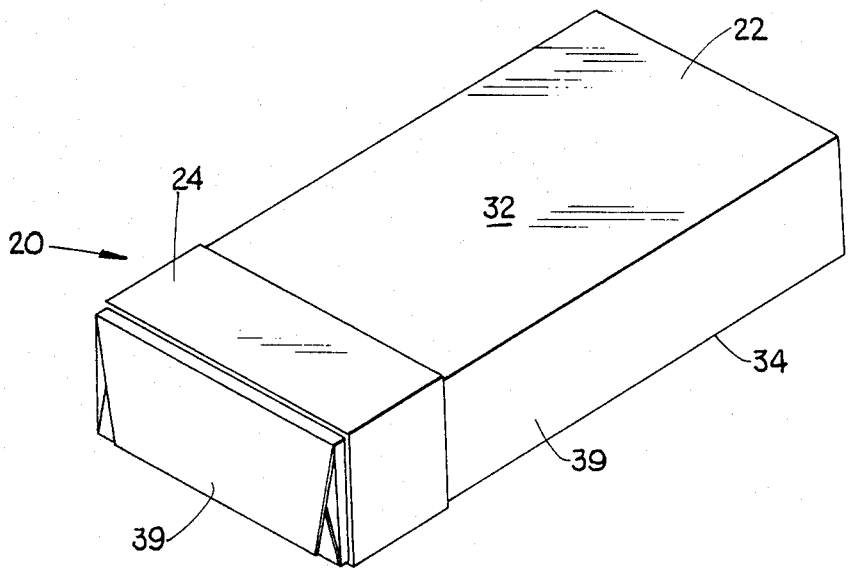
FIG. 1 is a perspective view of the cartonboard container of the present invention in a closed position.

In a particularly preferred embodiment shown in FIG. 1, the present invention is a cartonboard container, indicated generally as 20, for housing a sheet product 28. The container 20 is basically comprised of a receptacle 22 for housing a stack of individual sheet products 28, a sliding closure member 24, and a means for elevating 26 one end of the stack of individual product 28 units (seen in FIG. 3).

Figure 4:
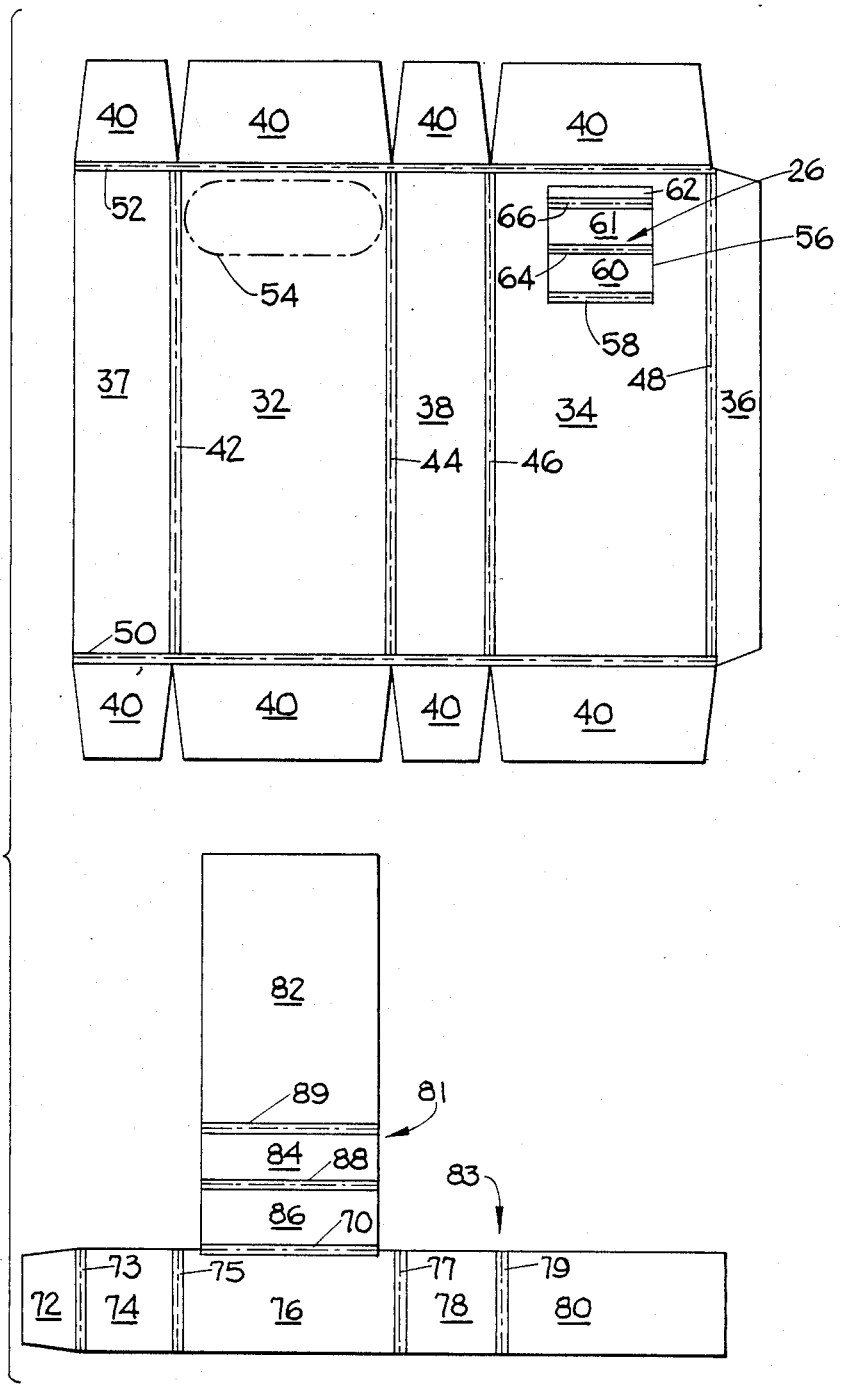
FIG. 4 is a plan view of the receptacle and sliding closure member blanks used to make the cartonboard container of FIG. 1.

The container 20 of the preferred embodiment is made from the two blanks seen in FIG. 4. The larger blank is the receptacle 22 forming blank and includes a top panel 32, a bottom panel 34 and a manufacturers joint 36. Additionally, the blank includes two side panels, 37 and 38, and two sets of four end flaps 40. Each set of end flaps 40 combine with the side panels, 37 and 38, to form a continuous side wall 39 (seen in FIG. 1) which encompasses and connects the top 32 and bottom 34 panels to form an enclosure. The panels 32, 34, 37 and 38 and the manufacturers joint 36 are separated from each other by axial score lines 42, 44, 46, and 48. Transverse score lines 50 and 52 separate the panels 32, 34, 37, and 38 from the end flaps 40.

Figure 2:
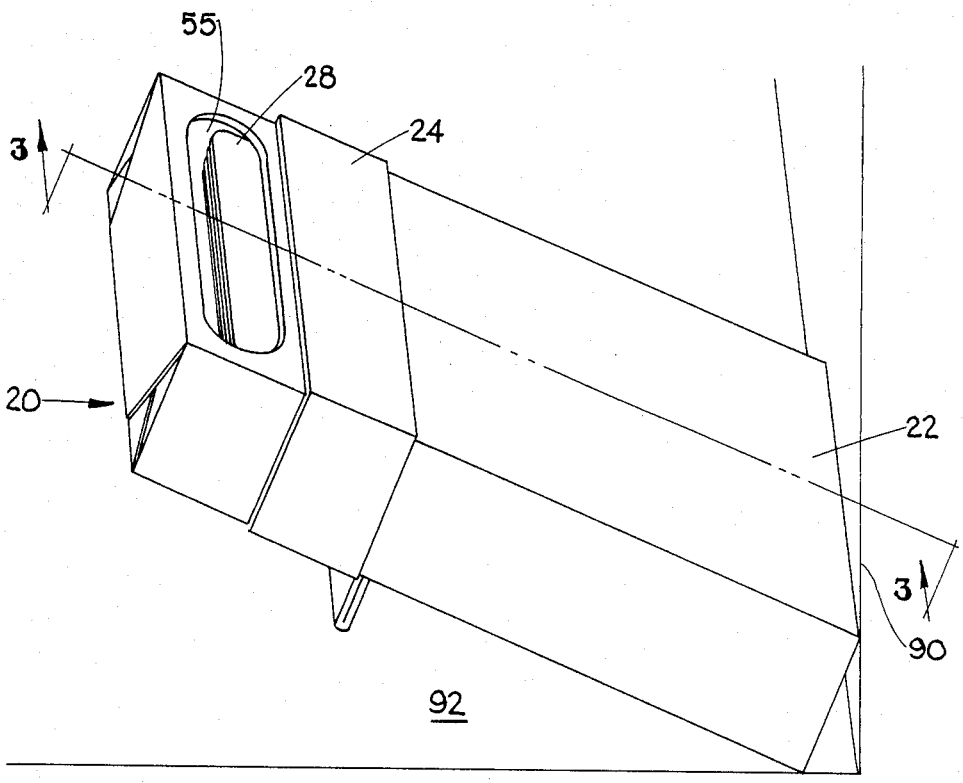
FIG. 2 is a perspective view of the cartonboard container of FIG. 1 in the open position.

The top panel 32 preferably has a perforated score line 54 which defines a dispensing aperture 55 as seen in FIG. 2. The perforated score line 54 is a tear line which enables the end user to separate the area within the score line 54 from the remainder of the top panel 32 with relative ease to form a dispensing aperture 55, as seen in FIG. 2. Alternatively, similar tear line features could substitute for the perforated score line 54 such as a cut score line, or simply completely removing the material within the tear line leaving the dispensing aperture 55.

The bottom panel 34 includes elevator means 26 which is delineated by a "U" shaped cut line 56 and a transverse score line 58. Within this area are two interior hinge panels 60 and 61 and a glue flap 62 separated from each other by transverse score lines 64 and 66. The axial length of each interior hinge panel 60 and 61 is preferably identical. This enables the greatest amount of elevation with the least amount of axial movement of the sliding closure member 24 and with the smallest opening in the bottom panel 34.

The smaller blank is the sliding closure member 24 forming blank and has a generally inverted "T" shape. This blank is comprised of two basic panels; an axial panel 81 and a transverse panel 83. These two panels 81 and 83 are connected to each other via a transverse score line 70. Each panel 81 and 83 is comprised of several sub-panels. The transverse panel 83 forms the sliding closure member 24 disposed about the receptacle 22. This transverse panel has five sub-panels 72, 74, 76, 78, and 80 separated from each other by axial score lines 73, 75, 77 and 79.

The sub-panels of the axial panel 81 include a glue panel 82 and two exterior hinge panels 84 and 86 separated from each other by transverse score lines 88 and 89. The axial dimension of the shorter of the interior hinge panels 60 and 61 is preferably longer than the axial dimension of the shorter of the exterior hinge panels 84 and 86. Also, the axial dimension of one of these interior panels 84 is preferably equal to the axial dimension of the other interior panel 86. The reasons for these preferences will be explained hereinafter in the discussion concerning the operation of the container 20.

Assembly of the cartonboard container 20 begins with the receptacle 22 forming blank. Assembly of the receptacle 22 forming blank is accomplished as with traditional cartonboard receptacles. The manufacturer's joint 36 is folded along axial score line 48, glue is applied thereto and the receptacle 22 forming blank is then folded along axial score line 44 thereby securing the manufacturers joint 36 to the underside of the side panel 37.

Assembly continues with attachment of the sliding closure member 24 forming blank to the receptacle 22. The glue panel 82 of the axial panel 81 is preferably adhered to the bottom panel 34 of the receptacle 22 throughout substantially its entire surface. This adds rigidity to the bottom panel 36, and consequently, to the entire container 20 structure. Alternatively, the dimensions of the glue panel 34 can be substantially reduced. Additionally, the glue flap 62 of the bottom panel 36 of the receptacle 22 blank is adhered near the edge of the middle sub-panel 76 of the transverse panel 83 of the sliding closure member 24 forming blank. Thus, the sliding closure member 24 is attached to the receptacle 22 at both its front and rear edges which increases the structural integrity of the container 20. The sliding closure member 24 forming blank is then folded along score line 73, glue is applied to the sub-panel 72 and the sliding closure member 24 forming blank is folded along score line 77 thereby adhering the sub-panel 72 to the left panel 80 of the closure member 24 surrounding the receptacle 22 blank.

Figure 5:
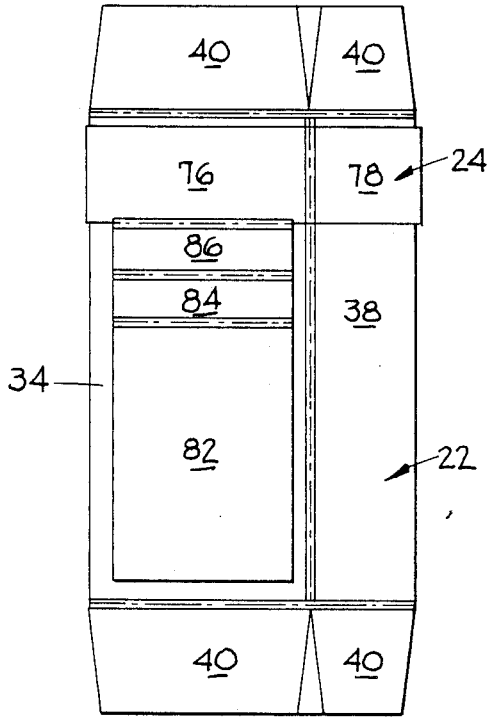
FIG. 5 is a bottom plan view of the sleeve formed from the blanks of FIG. 4.

In this collapsed, or sleeve configuration seen in FIG. 5 the container 20 can be shipped from its manufacturer to the manufacturer of the sheet product 28 units. The sleeve configuration is the standard method of shipping cartonboard containers from the container manufacturer to the product manufacturer. This configuration offers economy and ease of handling due to the reduced volume.

Figure 6:
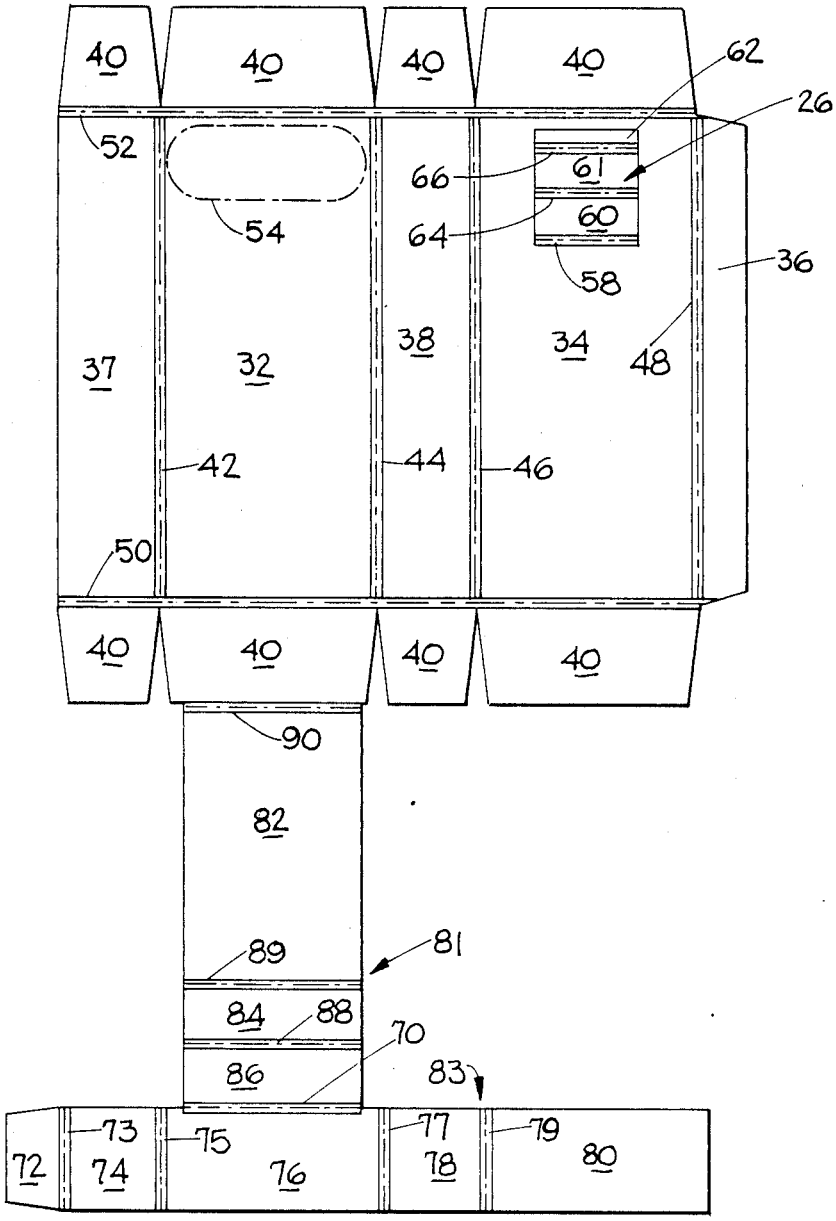
FIG. 6 is a plan view of an alternative one piece blank from which a cartonboard container of the present invention may be formed.
Figure 7:
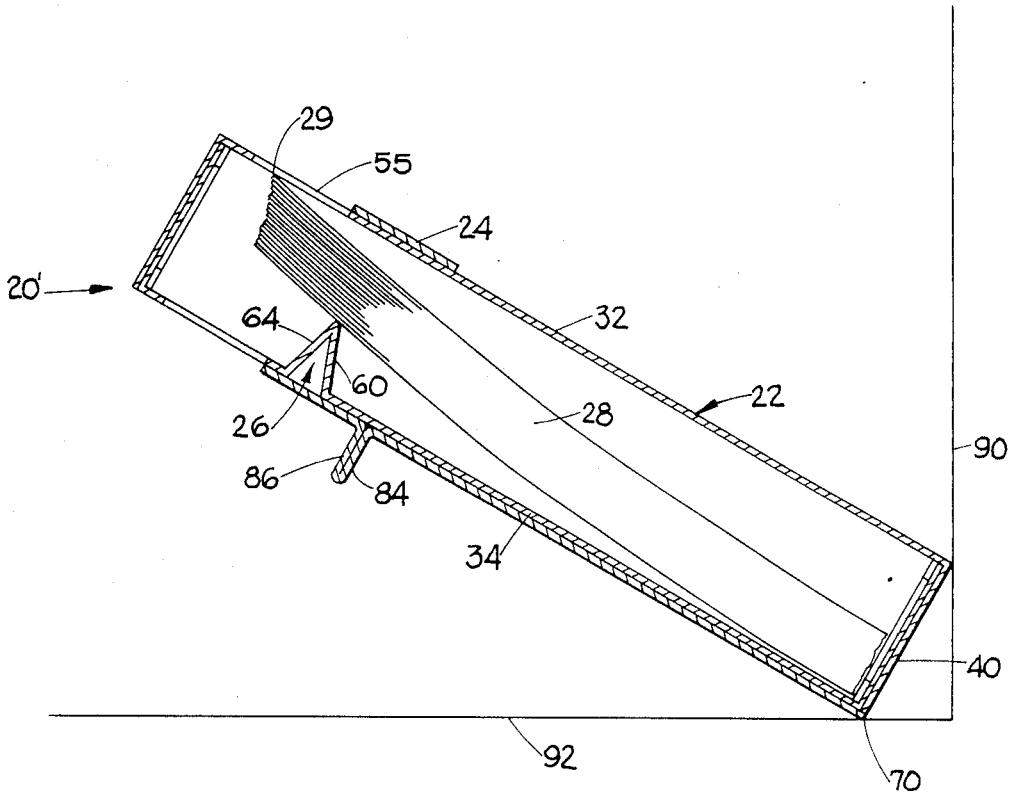
FIG. 7 is a cross-sectional view similar to FIG. 3 of the cartonboard container formed using the blank of FIG. 6.

FIG. 6 illustrates a first alternative embodiment of the blank which results in the container 20' seen in cross-section in FIG. 7. In this embodiment the glue panel 82 is an extension of the end flap 40 of the top panel 32. The glue panel 82 is connected to the end flap 40 of the top panel 32 via a score line 90. Thus, the container 20 is formed from one blank instead of two which can be easier for carton folding machinery to manipulate. More waste results when die cutting these one piece blanks than the two blanks of FIG. 4.

Figure 8:
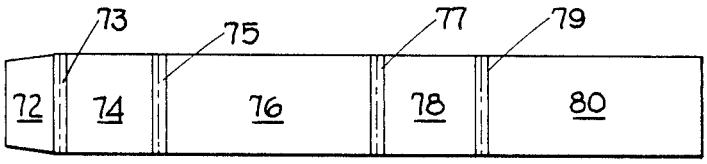
FIG. 8 is an alternative sliding closure member blank which may be used to make a cartonboard container of the present invention.
Figure 9:
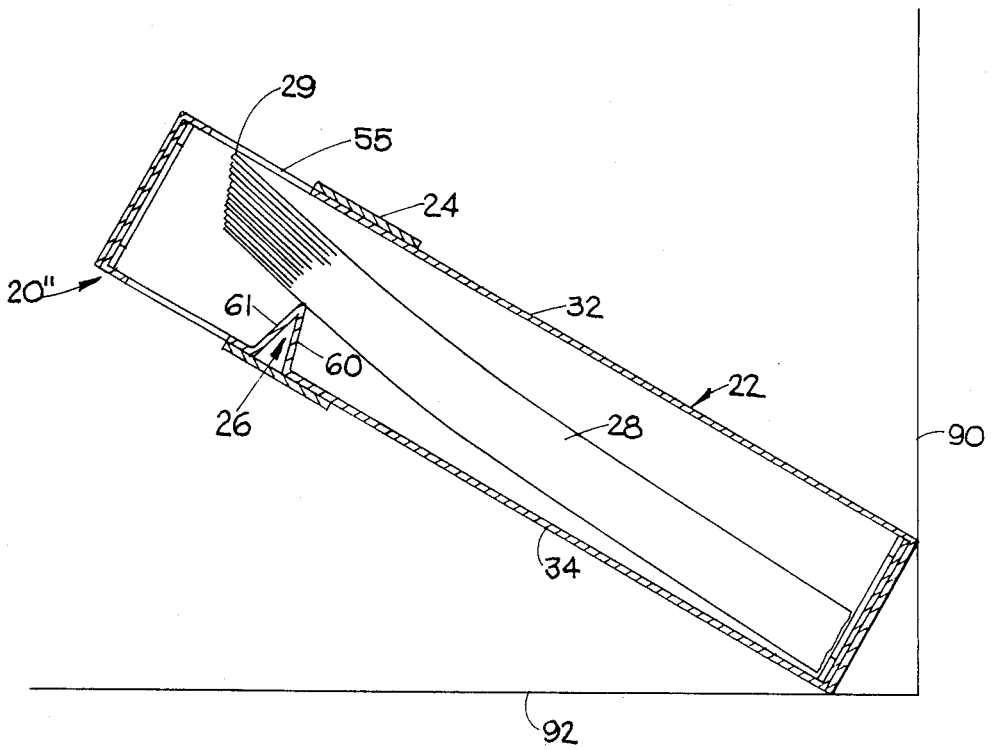
FIG. 9 is a cross-sectional view similar to FIG. 3 of the cartonboard container formed using the sliding closure member blank of FIG. 8.

FIG. 9 illustrates a second alternative embodiment of the container 20. The receptacle 22 of this embodiment is formed from the receptacle 22 forming blank seen in FIG. 4 and the sliding closure member 24 is formed from the blank seen in FIG. 8. The receptacle 22 forming blank is assembled as before and the sliding closure member 24 is attached to the glue flap 62 of the receptacle 22 as before. This embodiment has the advantage of requiring less cartonboard material to manufacture. However, this embodiment lacks the exterior hinge panels 84 and 86 which help bias the sliding closure member 24 toward the closed position when the container is returned to a resting surface.

Upon receipt of the sleeve of the preferred embodiment, the sheet product 28 manufacturer expands the sleeve, places a stack of individual sheet product 28 units inside, and folds and seals the end flaps 40 as with traditional containers. This operation results in the package seen in FIG. 1.

Figure 3:
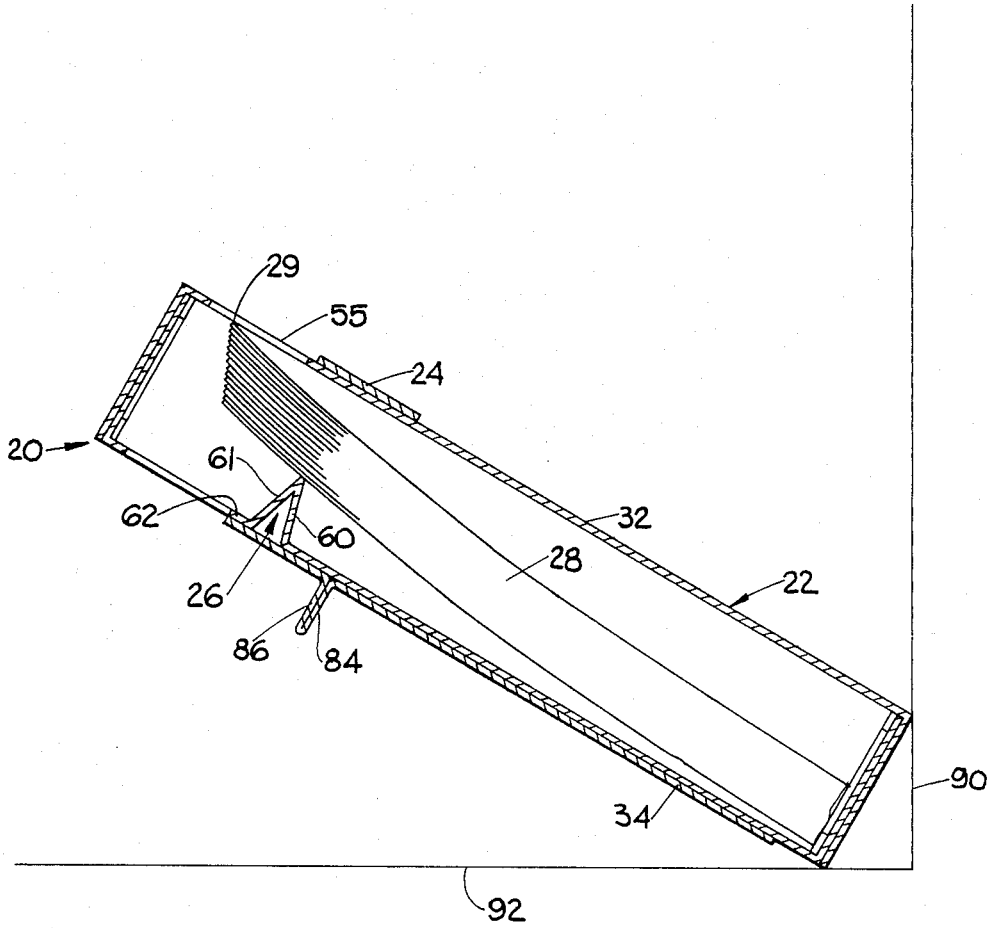
FIG. 3 is a cross-sectional view of the cartonboard container taken along line 3—3 of FIG. 2.

Referring to FIG. 1 and FIG. 3, the receptacle 22 consists of a top panel 32, a bottom panel 34 and a side wall 39 which circumscribes and connects the top panel 32 to the bottom panel 34 to form an enclosure. The sliding closure member 24 is disposed about the receptacle 22. The sliding closure member 24 may be selectively reciprocally slid axially along the receptacle 22 between a closed position and an open position. As seen in FIG. 3, the sliding closure member 24 is hingedly attached to interior hinge panels 60 and 61 via glue panel 62. This creates an elevator means 26 which is raised by sliding the closure member 24 from the closed to the open position.

Once the cartonboard container 20 is assembled and filled it is transported to a retailer who sells them to the ultimate consumer of the sheet products 28. To dispense sheet products 28 from the cartonboard container 20, the ultimate consumer axially slides the closure member 24 along the receptacle 22 from the closed position seen in FIG. 1 where it covers the dispensing aperture 55, to the open position seen in FIG. 2. The initial use of the container 20 of the preferred embodiment requires the consumer to remove the tear out area delineated by the perforated score line 54 to create the dispensing aperture 55. Removal of this area is accomplished by separating the tear out area from the top wall 32 and grasping and pulling out this area as with many current facial tissue containers.

Referring to FIG. 3, as the closure member 24 slides axially along the receptacle 22 from the closed position to the open position, both sets of hinge panels, the interior hinge panels 60 and 61, and the exterior hinge panels 84 and 86 move away from the bottom panel 34. As the sliding closure member 24 reaches the fully open position the exterior hinge panels 84 and 86 are forced against each other in back to back relation due to the container's 20 preferred geometry where the axial dimension of the shortest of the interior hinge panels 60 and 61 is longer than the axial dimension of the shortest of the exterior hinge panels 84 and 86. This stops movement of the sliding closure member 24. In this configuration, the sliding closure member 24 is in the open position. Thus, the interior hinge panels 60 and 61 stand in angular relation to each other in the open position. Therefore, the interior hinge panels 60 and 61 never meet in back to back relation which insures their stability and helps prevent collapse of the elevator means 26.

The movement of the interior hinge panels 60 and 61 away from the bottom panel 34, provides the means for elevating 26 one end of the stack of sheet products 28 toward the dispensing aperture 55. As the interior hinge panels 60 and 61 move toward the interior of the receptacle 22 they push upwardly near one end of the product 28 stack therein. Thus, one end of the product 28 is elevated toward the dispensing aperture 55 in the top wall 32. If the product stack 28 involves nonrigid items then a curvilinear profile results as seen in FIG. 3. As the end of the product 28 stack is raised the transverse edges 29 of the individual products 28 move axially relative to each other. The transverse edge 29 of the top sheet product 28 extends axially past the transverse edges 29 of the remaining sheet products 28. Therefore, it is relatively simple for the consumer to grasp the axially extended transverse edge 29 of the top product 28 and pull it through the dispensing aperture 55.

As the exterior hinge panels 84 and 86 move outwardly from the bottom panel 34 they protrude away from the receptacle 22. As the closure member 24 is axially moved to the open position, therefore, there should be nothing to obstruct these exterior hinge panels 84 and 86 or the sliding closure member 24 cannot move. Consequently, it is advantageous to tilt the container 20 off its resting surface, as seen in FIG. 3, with the end of the container 20 against a stationary object 90. Then, after dispensing the desired sheet product 28 the container 20 can be returned to its position resting on the bottom panel 34. As the container 20 is returned to this resting position, the resting surface 92 forces the exterior hinge panels 84 and 86 back against the bottom panel 34 which causes the sliding closure member 24 to close automatically. If the axial dimension of these exterior hinge panels 84 and 86 are not equivalent then as the exterior hinge panels 84 and 86 rest in back to back relation they will not extend from the bottom wall 34 at 90° but will instead foldover at an acute angle. Thus, the exterior hinge panels 84 and 86 may be pressed against the receptacle 22 without closing the container 20.

Although particular embodiments of the present invention have been shown and described, modification may be made to the package without departing from the teachings of the present invention. Accordingly, the present invention comprises all embodiments within the scope of the appended claims.

What I claim is:

1. A cartonboard container for housing and facilitating removal of sheet products one at a time comprising:

(a) a receptacle for housing a stack of individual sheet products, said receptacle having a top wall, a bottom wall and a side wall encompassing and connecting said top wall to said bottom wall to form an enclosure, said top wall having a dispensing aperture for removal of the sheet products individually therethrough;

(b) a sliding closure member disposed about the receptacle and being selectively reciprocally slideable axially along the top wall of the receptacle between a closed position covering said dispensing aperture in said top wall and an open position; and (c) a means hingedly attached to the sliding closure member and the receptacle for elevating one end of the stack of sheet products within the receptacle toward said dispensing aperture whereby manual grasping of one of said sheet products is facilitated.

2. A cartonboard container according to claim 1 wherein said means for elevating one end of the stack of sheet products is two interior hinge panels connecting said sliding closure member to said bottom wall and which extend inwardly when said sliding closure member is in the open position.

3. A cartonboard container according to claim 1 wherein said sliding closure member is connected to said bottom wall of said receptacle via two exterior hinge panels which protrude outwardly from said container when said sliding closure member is in the open position.

4. A cartonboard container according to claim 2 wherein said sliding closure member is connected to said bottom wall of said receptacle via two exterior hinge panels which protrude outwardly from said container when said sliding closure member is in the open position.

5. A cartonboard container according to claim 4 wherein the axial dimension of the shorter of the interior hinge panels is greater than the axial dimension of the shorter of the exterior hinge panels.

6. A cartonboard container according to claim 2 wherein each of said interior hinge panels have the same axial dimension.

7. A cartonboard container according to claim 4 wherein each of said interior hinge panels have the same axial dimension.

8. A cartonboard container according to claim 3 wherein each of said exterior hinge panels have the same axial dimension.

9. A cartonboard container according to claim 7 wherein the axial dimension of each of said interior hinge panels is greater than the axial dimension of said exterior hinge panels.

10. A cartonboard container for housing and facilitating removal of sheet products one at a time comprising:

(a) a receptacle for housing a stack of individual sheet products, said receptacle having a top wall, a bottom wall and a side wall encompassing and connecting said top wall to said bottom wall to form an enclosure, said top wall having a dispensing aperture for removal of the sheet products individually therethrough;

(b) a stack of individual sheet products located within said receptacle;

(c) a sliding closure member disposed about the receptacle and being selectively reciprocally slideable axially along the receptacle between a closed position covering said dispensing aperture and an open position; and (d) a means hingedly attached to the sliding closure member and the receptacle for elevating one end of the stack of sheet products within the receptacle toward said dispensing aperture whereby manual grasping of one of said sheet products is facilitated.

11. A cartonboard container according to claim 10 wherein said means for elevating one end of the stack of sheet products is two interior hinge panels connecting said sliding closure member to said bottom wall and which extend inwardly when said sliding closure member is in the open position, and wherein said sliding closure member is connected to said bottom wall of said receptacle via two exterior hinge panels which protrude outwardly from said container when said sliding closure member is in the open position.

12. A blank for forming a cartonboard container according to claim 1 comprising: a receptacle forming blank comprising a bottom panel, a top panel, two side panels and a manufacturers joint being connected to each other via axial score lines, and further including end flaps being connected to the transverse ends of said panels via a transverse score line, said end flaps and said panels being connected to each other such that the receptacle can be formed therefrom; said top panel having a dispensing aperture and said bottom panel having two interior hinge panels connected thereto via a transverse score line; and a sliding closure member forming blank including a transverse panel divided by axial score lines into five sub-panels.

13. A blank according to claim 12 wherein said sliding closure member forming blank is T-shaped and further comprises an axial panel including a glue panel and two exterior hinge panels separated from each other by transverse score lines, said axial panel connected to said transverse panel via a transverse score line.

14. A blank according to claim 13 wherein said T-shaped sliding closure member forming blank is integrally formed with said receptacle forming blank as an extension of said top panel.

15. A blank according to claim 13 wherein the axial dimension of the shorter of the interior hinge panels is greater than the axial dimension of the shorter of the exterior hinge panels.

16. A blank according to claim 12 wherein each of said interior hinge panels have the same axial dimension.

17. A blank according to claim 13 wherein each of said exterior hinge panels have the same axial dimension.

18. A blank according to claim 17 wherein each of said interior hinge panels have the same axial dimension.

19. A blank according to claim 18 wherein the axial dimension of each of said interior hinge panels is greater than the axial dimension of each of said exterior hinge panels.

20. A blank according to claim 12 wherein said dispensing aperture is delimited by a tear line and formed by manually removing the area within said tear line.

* * * * *